US012680767B2

(12) United States Patent
Gördeler et al.

(10) Patent No.: US 12,680,767 B2
(45) Date of Patent: Jul. 14, 2026

(54) HEAT EXCHANGER FOR A MOTOR VEHICLE WITH AN ALUMINUM ALLOY AND METHOD OF MANUFACTURE

(71) Applicant: MAHLE INTERNATIONAL GMBH, Stuttgart (DE)

(72) Inventors: Matthias Gördeler, Stuttgart (DE); Alexander Wald, Sindelfingen (DE); Thomas Feldhege, Leinfelden-Echterdingen (DE)

(73) Assignee: MAHLE International GmbH, Stuttgart (DE)

( * ) Notice: Subject to any disclaimer, the term of this patent is extended or adjusted under 35 U.S.C. 154(b) by 201 days.

(21) Appl. No.: 18/626,958

(22) Filed: Apr. 4, 2024

(65) Prior Publication Data

US 2024/0337453 A1 Oct. 10, 2024

(30) Foreign Application Priority Data

Apr. 6, 2023 (DE) ..... 102023108950.1
Sep. 11, 2023 (DE) ..... 102023124479.5

(51) Int. Cl.
*F28F 21/08* (2006.01)
*C22C 21/06* (2006.01)
(Continued)

(52) U.S. Cl.
CPC ..... *F28F 21/084* (2013.01); *C22C 21/06* (2013.01); *C22C 21/14* (2013.01); *C22C 21/16* (2013.01);
(Continued)

(58) Field of Classification Search
CPC ..... C22C 30/06; C22C 30/02; C22C 21/18; C22C 21/14; C22C 21/06;
(Continued)

(56) References Cited

U.S. PATENT DOCUMENTS 5,041,343 A * 8/1991 Fortin ..... B23K 35/286 428/654
6,129,143 A * 10/2000 Hasegawa ..... B32B 15/016 428/933
(Continued)

FOREIGN PATENT DOCUMENTS

CN 103122428 5/2013
DE 102008059450 6/2010

OTHER PUBLICATIONS

Aluminum and aluminum alloys—Wrought products—Temper designations; German version EN 515:2017, CEN-CENELEC Management-Zentrum, May 2017.
(Continued)

*Primary Examiner* — Claire E Rojohn, III
(74) *Attorney, Agent, or Firm* — Barnes & Thornburg

(57) ABSTRACT

A heat exchanger for a motor vehicle is provided. The heat exchanger contains at least one element that contains aluminum. This element that contains aluminum has a core and at least one plating layer. The core is composed of a first aluminum alloy that contains approx. 0.5% to approx. 4% by weight Mn, and approx. 0.5% to approx. 4% by weight Mg. The at least one plating layer is composed of at least one other aluminum alloy.

15 Claims, 2 Drawing Sheets

Figure 1:
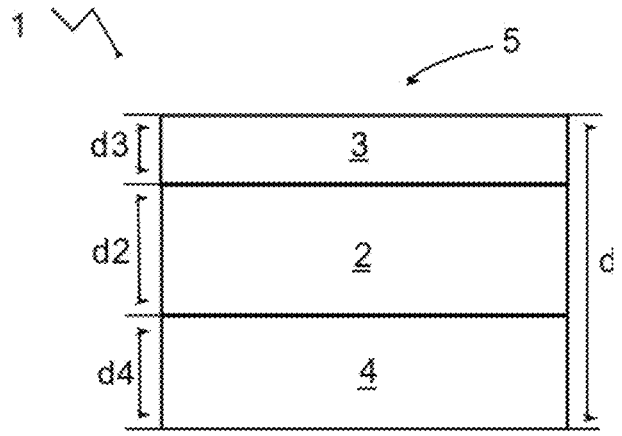

(51) Int. Cl.

| | |
|---|---|
| ***C22C 21/14*** | (2006.01) |
| ***C22C 21/16*** | (2006.01) |
| ***C22C 21/18*** | (2006.01) |
| ***C22C 30/02*** | (2006.01) |
| ***C22C 30/06*** | (2006.01) |
| ***F28D 21/00*** | (2006.01) |

(52) U.S. Cl.
CPC ..... *C22C 21/18* (2013.01); *C22C 30/02* (2013.01); *C22C 30/06* (2013.01); *F28F 21/089* (2013.01); *F28D 2021/0091* (2013.01); *F28F 2275/025* (2013.01)

(58) Field of Classification Search
CPC ..... F28D 2021/0091; F28F 21/084; F28F 21/089; F28F 2275/025
USPC ..... 165/133; 428/654
See application file for complete search history.

(56) References Cited

U.S. PATENT DOCUMENTS 6,555,251 B2 * 4/2003 Kilmer ..... C22C 21/16 138/143
6,627,330 B1 * 9/2003 Shimizu ..... F28F 21/084 148/528
7,255,932 B1 * 8/2007 Kilmer ..... B23K 35/286 165/905
7,648,776 B2 * 1/2010 Vieregge ..... B23K 35/286 428/650
8,158,273 B2 * 4/2012 Wittebrood ..... B23K 35/002 165/905
8,343,635 B2 * 1/2013 Matsumoto ..... F28F 1/126 165/905
8,349,470 B2 * 1/2013 Marois ..... B23K 1/0012 165/905
8,763,880 B2 * 7/2014 Wittebrood ..... B23K 35/38 228/56.3
8,986,850 B2 * 3/2015 Baumann ..... F28F 21/089 165/905
9,012,033 B2 * 4/2015 Matsuo ..... F28F 19/06 165/905
9,033,206 B2 * 5/2015 Edo ..... B23K 35/22 228/183
9,080,500 B2 * 7/2015 Grunenwald ..... F02M 26/32
9,085,328 B2 * 7/2015 Bassi ..... B62D 25/085
9,127,860 B2 * 9/2015 Yuan ..... F24S 10/503
9,327,365 B2 * 5/2016 Matsukado ..... C22C 21/00
9,364,913 B2 * 6/2016 Takewaka ..... B23K 1/20
9,726,439 B2 * 8/2017 Omae ..... F28F 1/006
9,857,128 B2 * 1/2018 Furumura ..... C22F 1/04
9,908,202 B2 * 3/2018 Marois ..... B23K 35/288
10,006,724 B2 * 6/2018 Perrier ..... C22C 21/00
10,150,186 B2 * 12/2018 Yanagawa ..... F28F 1/02
10,156,000 B2 * 12/2018 Oskarsson ..... B23K 35/0233
10,179,379 B2 * 1/2019 Ren ..... B23K 35/286
10,486,269 B2 * 11/2019 Jacoby ..... F28F 21/084
10,661,395 B2 * 5/2020 Ichikawa ..... B23K 1/008
10,737,357 B2 * 8/2020 Itoh ..... C22C 21/00
10,898,963 B2 * 1/2021 Miyake ..... B23K 35/286
10,926,319 B2 * 2/2021 Hunter ..... C22C 21/02
10,926,361 B2 * 2/2021 Gruenewald ..... F28F 21/084
11,007,609 B2 * 5/2021 Itoh ..... C22C 21/02
11,097,380 B2 * 8/2021 Anderson ..... B23K 35/0227
11,298,779 B2 * 4/2022 Itoh ..... C22C 21/02
11,320,217 B2 * 5/2022 Yanagawa ..... B23K 35/286
11,491,585 B2 * 11/2022 Baumann ..... B23K 35/383
11,571,769 B2 * 2/2023 Yanagawa ..... C22C 21/00
11,697,179 B2 * 7/2023 Kulovits ..... B23K 35/0238 428/654
12,397,377 B2 * 8/2025 Jacoby ..... B23K 35/0238
12,466,004 B2 * 11/2025 Yanagawa ..... B32B 15/016
12,533,755 B2 * 1/2026 Jacoby ..... B23K 35/0238
2002/0142185 A1 * 10/2002 Kilmer ..... B32B 15/016 428/654
2003/0150532 A1 * 8/2003 Marois ..... F28F 21/084 148/521
2004/0238605 A1 * 12/2004 Nishimura ..... B23K 35/0238 228/264
2005/0011636 A1 * 1/2005 Miyachi ..... F28F 21/084 165/905
2007/0051503 A1 * 3/2007 Grajzl ..... F28F 19/06 165/152
2007/0204935 A1 * 9/2007 Safrany ..... B23K 1/20 148/275
2009/0123730 A1 * 5/2009 Boger ..... B23K 1/19 428/323
2010/0108304 A1 * 5/2010 Nies ..... F28F 9/0229 165/173
2010/0151273 A1 * 6/2010 Wittebrood ..... C22C 21/02 428/650
2011/0111254 A1 * 5/2011 Wittebrood ..... C22C 21/02 228/221
2011/0290458 A1 * 12/2011 Gruenenwald ..... F28F 19/06 165/157
2015/0037607 A1 * 2/2015 Itoh ..... C22C 21/00 428/654
2015/0053751 A1 * 2/2015 Eckhard ..... C22C 21/02 164/76.1
2016/0325367 A1 * 11/2016 Eckhard ..... B23K 35/288
2017/0234630 A1 * 8/2017 Feldhege ..... F28F 21/084 165/133
2018/0017333 A1 * 1/2018 Feldhege ..... F28D 9/005
2018/0200842 A1 * 7/2018 Itoh ..... B23K 35/22
2018/0251878 A1 * 9/2018 Kadali ..... C22C 21/08
2020/0080172 A1 * 3/2020 Kadali ..... C22F 1/043
2021/0114144 A1 * 4/2021 Chehab ..... B23K 35/286
2022/0098706 A1 * 3/2022 Luo ..... C22F 1/043
2022/0271366 A1 * 8/2022 Cate ..... F28D 1/03
2022/0324065 A1 * 10/2022 Kadali ..... C22C 21/02
2023/0049185 A1 * 2/2023 Jacoby ..... B32B 15/016
2024/0271891 A1 * 8/2024 Feldhege ..... F16L 9/02
2024/0337453 A1 * 10/2024 Gördeler ..... C22C 30/06

OTHER PUBLICATIONS

Metallic materials—Tensile testing—Part 1: Method of test at room temperature (ISO 6892-1:2019); German version EN ISO 6892-1:2019, CEN-CENELEC Management-Zentrum, Jun. 2020.
Search Report from German Patent Application No. 1020231244795 (Jul. 10, 2024).
Standard Test Methods for Tension Testing of Metallic Materials, American Association State Highway and Transportation Officials Standard, 2021, pp. 73-102.

* cited by examiner

HEAT EXCHANGER FOR A MOTOR VEHICLE WITH AN ALUMINUM ALLOY AND METHOD OF MANUFACTURE

CROSS-REFERENCE TO RELATED APPLICATIONS

This application claims priority from German Patent Application No. DE 102023108950.1, filed Apr. 6, 2023, and from German Patent Application No. DE 102023124479.5, filed Sep. 11, 2023, the entirety of which are both fully incorporated by reference herein.

The invention relates to a heat exchanger for a motor vehicle containing a core layer made of an aluminum alloy and at least one plating layer, and at method for producing a heat exchanger for a motor vehicle containing a core layer made of an aluminum alloy and at least one plating layer according to the independent claims.

Heat exchangers for thermal management in motor vehicles in the motor, transmission, and passenger compartment are normally made of aluminum or aluminum alloys.

The use of recycled substances has gained increasing importance in the industry with regard to sustainability and the carbon footprint. Corrosion resistance is also important in the field of heat exchangers.

The present invention therefore addresses the problem of creating a heat exchanger for a motor vehicle and a method for the production thereof that results in a lower carbon footprint without compromising the corrosion resistance.

This problem is solved according to the invention by the subject matter of the independent claims. Advantageous embodiments are the subject matter of the dependent claims.

According to the invention, the heat exchanger for a motor vehicle contains at least one element that contains aluminum, which has a core and at least one plating layer, with the core made of a first aluminum alloy, which contains approx. 0.5% to approx. 4% by weight Mn, and approx. 0.5% to approx. 4% by weight Mg, and the at least one plating layer is made of at least one other aluminum alloy.

It should be noted that the two German terms for "heat exchanger" are used synonymously in the German language version of the present application.

The present invention also relates to a method for the production of a heat exchanger for a motor vehicle in which there is at least one element that contains aluminum, and a second component, and the at least one element that contains aluminum has a core made of a first aluminum alloy, and the first aluminum alloy contains approx. 0.5% to approx. 4% by weight Mn and approx. 0.5% to approx. 4% by weight Mg.

The heat exchanger according to the invention for a motor vehicle and the method for producing such, which have the features of the independent claims, has the substantial advantage over the prior art that the aluminum alloys can contain high recycling content, and high tensile strengths can be obtained, while the protective plating exhibits a high corrosion resistance.

It is particularly advantageous that high recycling content can be obtained, even though it is difficult to remove alloy elements, e.g. magnesium, when recycling aluminum alloys.

Another substantial advantage of the invention is that by introducing both magnesium and manganese, the alloy is much more durable than pure aluminum, as is the case when just magnesium is used (e.g. EN AW-5xxx alloys). This also results in a more robust finished product.

The heat exchanger according to the invention for a motor vehicle and the method according to the invention for producing a heat exchanger for a motor vehicle shall be explained in greater detail below, in which the drawings referenced in the explanations of the heat exchanger for a motor vehicle also apply to the method for producing a heat exchanger for a motor vehicle, and vice versa.

Heat exchangers are made of tubes through which coolants flow, which can be stacked, with cooling fins between the tubes to increase heat exchange. This allows air to be conducted through the heat exchanger, which absorbs and discharges heat from the coolant.

Battery cooling plates are also typically made of aluminum or aluminum alloys. These battery cooling plates are normally heat exchangers made of large plates, normally in pairs, which are structured to conduct a refrigerant in order to discharge heat from a battery.

There are also other heat exchangers, e.g. coolers made of stacked plates, which are also typically made of aluminum or aluminum alloys.

As long as not otherwise specified in the description of the present invention, the element that contains aluminum according to the invention can be used for any conceivable heat management applications in all conceivable forms of heat exchangers for motor vehicles. The element that contains aluminum can therefore take the form of a plate, sheet, or tube, without being limited thereto, each of which can also be corrugated, or contoured in any conceivable manner.

Aluminum alloys are those alloys with an aluminum base, to which other elements have been added that affect the properties thereof. The person skilled in the art knows that the main component of an aluminum alloy is aluminum, and that the sum total of all of the components adds up to 100% by weight.

According to European standards, e.g. DIN EN 515, aluminum wrought alloys are indicated by EN AW, followed by a number representing the composition. EN AW-3104 is a representative of the class EN AW-3000, for example. This can also be written as EN AW-3xxx, for example. There is often an additional indicator as well, e.g. "Hxx," in which case the "xx" represents two natural numbers or "O". This additional indicator represents the tempering state (also referred to as the thermal treatment state) for the material. The person skilled in the art knows that the tempering state of an alloy affects the properties of the material. These indicators can be found in available datasheets.

The tempering state can be obtained in a conventional thermal treatment furnace typically used with alloys for heat exchangers in the prior art. This can also be obtained using an annealing furnace. These annealing furnaces are not normally used in the prior art for heat exchanger alloys.

The term "mod." is also used in the context of aluminum alloys in the framework of the present invention. By way of example, "EN AW-3104 H19" means the same as "EN AW-3104 mod. H19" in the framework of the invention. "EN AW-3003 mod. +Zn," for example, refers to an aluminum alloy, EN AW-3003, to which zinc has been added. These terms are used for all of the aluminum alloys in this application.

Aluminum alloys from the class EN AW-3000, which contain manganese as well as magnesium, have advantageous properties with regard to recycling and tensile strength.

By way of example, EN AW-3104 (also referred to as AlMn1Mg1Cu) is a known aluminum alloy that is often used for beverage containers.

EN AW-3104 has not yet been used for soldered heat exchangers, because this aluminum alloy cannot be used in brazing processes, e.g. in inert gas atmospheres. EN AW-3104 also does not satisfy the corrosion requirements for the automotive industry.

However, EN AW-3104 has a high tensile strength. By way of example, for the tempering state "H19," which is us typically used for the production of beverage containers, the typical tensile strength is >250 MPa. In particular, EN AW-3104 is readily recyclable. Good recycling properties are typically characterized in that the aluminum alloy in question can contain any of the alloy elements typically used in aluminum alloys. The main alloy elements in EN AW-3104 are Mn and Mg, as well as Cu and other elements such as Si, Fe, and Zn, and small amounts of other elements.

There can be further restrictions for the use in heat exchangers. A major advantage with this is that more than 50% or even 80% can then be recycled.

The tensile strength can be determined in a tensile test, in which the tensile strength is calculated from the maximum tensile force that is reached in relation to cross-section area of the sample at the start of the test. At room temperature, the tensile strength can be determined on the basis of DIN EN ISO 6892-1 or ASTM E8.

As long as not otherwise specified, any of the tempering states "Hxx" typically used for components can be used in the aluminum alloys used for the invention. The tempering state "H19" has proven to be particularly advantageous in the prior art, particular in the production of beverage containers. For the present invention, however, it has proven to be the case that a tempering state of "O," "H111," "H14," "H16," "H22," or "H24" is particularly advantageous for the first aluminum alloy in the core.

Plating metals, specifically aluminum and aluminum alloys, is known from the prior art. Basically, any of the conventional method for plating aluminum or aluminum alloys can be used. By way of example, the plating can be applied by rolling thin metal foils thereon, welding, ion-plating, immersion methods, explosive cladding, or electroplating. Roll cladding has proven to be particularly advantageous. The material used for the plating is placed on the material that is to be plated in this case, and both materials are heated and pressed together by a pair of rollers.

A core made of a first aluminum alloy containing 0 to 1.0% by weight Si, 0 to 1.0% by weight Fe, 0.05 to 0.8% by weight Cu, 0.5 to 2.0% by weight Mn, 0.5 to 2.0% by weight Mg, 0 to 1.0% by weight Zn, and less than 0.05% by weight other components, more preferably 0 to 0.6% by weight Si, 0 to 0.8% by weight Fe, 0.05 to 0.25% by weight Cu, 0.8 to 1.4% by weight Mn, 0.8 to 1.3% by weight Mg, 0 to 0.25% by weight Zn, and less than 0.05% by weight other components, has proven to be particularly advantageous.

It has also proven to be advantageous when the first aluminum alloy contains 0 to 0.6% by weight Si, 0 to 0.8% by weight Fe, 0.05 to 0.25% by weight Cu, 1.1 to 1.4% by weight Mn, 0.8 to 1.3% by weight Mg, 0 to 0.25% by weight Zn, and less than 0.05% by weight other components.

One example of such an aluminum alloy contains 0.6% by weight Si, 0.8% by weight Fe, 0.25% by weight Cu, 1.4% by weight Mn, 1.3% by weight Mg, 0.25% by weight Zn, 0.01% by weight other components, and 95.39% by weight Al.

The person skilled in the art also knows that these alloys typically contain small amounts of other components, depending on the starting materials and the production process. By way of example, but not limited thereto, these impurities can contain trace amounts of Cr, Ni, Zn, Ga, V, or Ti.

The preferred composition of the aluminum alloy for the core is summarized in the following table:

TABLE 1

| Element | Si | Fe | Cu | Mn | Mg | Zn | Other |
|---|---|---|---|---|---|---|---|
| Min. | — | — | 0.05 | 0.5 | 0.5 | — | — |
| Max. | 1.0 | 1.0 | 0.8 | 2.0 | 2.0 | 1.0 | <0.05 |

The more preferred composition of the aluminum alloy for the core is summarized in the following table:

TABLE 2

| Element | Si | Fe | Cu | Mn | Mg | Zn | Other |
|---|---|---|---|---|---|---|---|
| Min. | — | — | 0.05 | 0.8 | 0.8 | — | — |
| Max. | 0.6 | 0.8 | 0.25 | 1.4 | 1.3 | 0.25 | <0.05 |

It is also conceivable that the aluminum alloy that is used can have any of the tempering states "Hxx" typically used for components. It has proven to be particularly advantageous for the first aluminum alloy in the core to have a tempering state of "O," "H111," "H14," "H16," "H22," or "H24."

The composition of such an aluminum alloy can typically be determined through chemical analysis. One standard method for chemical analysis of aluminum alloys, which can be used to analyze the present materials, is optical emission spectrometry. Spark optical emission spectroscopy (spark OES) or glow-discharge optical emission spectroscopy (GDOES) can be used for this.

It has also proven to be advantageous when the core has at least one second plating layer, which is placed on the side of the core opposite the first plating layer.

This has particular advantages regarding the corrosion resistance.

It is also advantageous when the at least one plating layer contains 0.006 to 0.8% by weight Si, 0.006 to 0.8% by weight Fe, 0.003 to 0.20% by weight Cu, 0.002 to 0.30% by weight Mn, 0.006 to 0.30% by weight Mg, 0.006 to 1.5% by weight Zn, and less than 0.05% by weight other components.

It is also advantageous when the at least one second plating layer contains 0.006 to 0.8% by weight Si, 0.006 to 0.8% by weight Fe, 0.003 to 0.20% by weight Cu, 0.002 to 0.30% by weight Mn, 0.006 to 0.30% by weight Mg, 0.006 to 1.5% by weight Zn, and less than 0.05% by weight other components.

It is also advantageous when the at least one plating layer and the at least one second plating layer contain 0.006 to 0.8% by weight Si, 0.006 to 0.8% by weight Fe, 0.003 to 0.20% by weight Cu, 0.002 to 0.30% by weight Mn, 0.006 to 0.30% by weight Mg, 0.006 to 1.5% by weight Zn, and less than 0.05% by weight other components.

With regard to the chemical composition and the analysis of thereof in the aluminum alloy for such a plating layer, the same applies that has already been explained above with regard to the composition of the aluminum alloy for the core.

A preferred composition of the aluminum alloy for the plating layers is summarized in the following table:

TABLE 3

| Element | Si | Fe | Cu | Mn | Mg | Zn | Other |
|---|---|---|---|---|---|---|---|
| Min. | 0.006 | 0.006 | 0.003 | 0.002 | 0.006 | 0.006 | — |
| Max. | 0.8 | 0.8 | 0.20 | 0.30 | 0.30 | 1.5 | <0.05 |

By way of example, it has proven to be advantageous to use one of the following aluminum alloys for the at least one plating layer and the at least one second plating layer: EN AW-1xxx, EN AW-3xxx, or EN AW-7xxx, preferably EN AW-1050, EN AW-1100, or EN AW-1200.

Alternatively, it has proven to be advantageous to use one of the following aluminum alloys for the at least one plating layer: EN AW-1xxx, EN AW-3xxx, or EN AW-7xxx, preferably EN AW-1050, EN AW-1100, or EN AW-1200.

In another alternative, it has proven to be advantageous to use one of the following aluminum alloys for the second plating layer: EN AW-1xxx, EN AW-3xxx, or EN AW-7xxx, preferably EN AW-1050, EN AW-1100, or EN AW-1200.

It is therefore conceivable to use the same aluminum alloy for both plating layers, or to use different aluminum alloys for each plating layer.

Normally, the individual elements of these heat exchangers have previously been bonded to one another by brazing. Brazing aluminum takes place at temperatures of greater than 400° C. These temperatures can often range from 590° C. to 620° C., depending on the brazing material. This brazing of components made of aluminum or aluminum alloys requires a lot of energy. Brazing also requires other substances such as water, flux, binder, and wetting agents. Because of the high temperatures and corrosion resistance requirements, high-grade materials are required.

To avoid the aforementioned disadvantages, it has proven to be particularly advantageous to glue the at least one element that contains aluminum to at least one other component.

This saves a lot of energy typically needed for soldering.

Any of the adhesive systems used for gluing metal can be used. A physically hardening adhesive system containing polyamide resins, saturated polyester, ethylene-vinyl acetate copolymers, polyolefins, styrol-butadiene-styrol block copolymers, or polyimides, or a chemically hardening adhesive system containing epoxy resins, polyurethane, phenol-formaldehyde resins, silicones and cyan acrylates is advantageous. An adhesive system containing epoxy resins or polyurethane has proven to be particularly advantageous. A physically hardening adhesive system containing polypropylene has proven to be particularly advantageous. These systems can be typically obtained as hot-melt polypropylene in the form of a film.

Typical temperatures for processing physically hardening adhesive systems are 120° to 240° C.

The surfaces are cleaned prior to gluing, and pretreated with an alkali or acid. By way of example, a solution for an acid surface treatment can contain 10 to 25 g/l $H_2SO_4$, 0.5 g/l HF, or a mixture thereof. Other acids that can be contained in the solution are $H_3PO_4$, HCl and/or $HNO_3$. A solution for an alkali surface treatment can contain 0.5 to 20% by weight NaOH and/or KOH. This solution could also contain surfactants.

It is clear that after the cleaning, acid or alkali residues must be neutralized and washed off.

It has also proven to be advantageous when a bonding agent that contains both titanium and zirconium is placed on the surface of the element that contains aluminum, at least where the adhesive bond is to be formed. Preferably, the bonding agent is applied to both the element that contains aluminum and the second component. Preferably, the entire surface of the element that contains aluminum and the second component is coated with the bonding agent. This is particularly the case when it is easier to coat the entire surface of the component than just a portion thereof.

The bonding agent preferably contains at 3 mg/m$^2$ to 30 mg/m$^2$ of titanium and zirconium.

The bonding agent preferably contains 10 to 20% fluoride atomically, measured using energy dispersive X-ray analysis at an excitation voltage of 5 kV, or at 3 to 12% atomically, measured using energy dispersive X-ray analysis at an excitation voltage of 20 KV. The detector is typically at a distance of 18 to 23 mm.

These adhesive systems have not been widely used in heat exchangers for motor vehicles because they are less durable than brazing at high temperatures, and tend to decompose when they come in contact with coolants, or do not adhere well to an aluminum substrate. These systems have received renewed attention due to the relatively low coolant temperatures in electric vehicles.

The thickness of the first plating layer and the thickness of the second plating layer is preferably 5 to 20% of the overall thickness of the element that contains aluminum, preferably 10 to 15% thereof.

Alternatively, the thickness of the at least one plating layer is 5 to 20% of the overall thickness of the element that contains aluminum, preferably 10 to 15% thereof.

The thickness of the second plating layer is also preferably 5 to 20% of the overall thickness of the element that contains aluminum, preferably 10 to 15% thereof.

The thicknesses of the platings can be determined using metallographic cross-cutting.

The portion of recycled aluminum in the element that contains aluminum is preferably more than 50%, at least in the core, and preferably more than 80%.

It is particularly advantageous to use alloys for which recycling has already been established. One such alloy is EN AW-3104, which is used for recyclable beverage containers.

Aluminum recycling is understood to mean the reuse of aluminum waste products, which are not necessarily pure aluminum, but can also be a variety of aluminum alloys. Recycling without loss of quality is more difficult than with a loss of quality, because with the former, the aluminum alloys must be sorted prior to recycling, but in the latter case, they can be mixed together. Supplements typically containing chloride salts are added to the aluminum waste products during the recycling process as they are melted down. Recycling aluminum requires significantly less energy than the production process for primary aluminum, which normally involves obtaining aluminum ore, which is then converted to aluminum oxide and subsequently reduced in a smelting process to obtain aluminum. The production of recycled aluminum typically requires only 5% of the energy needed to produce the same amount primary aluminum.

The aluminum alloys used for the first and second plating layers are preferably at least 10 mV more electron-negative than the alloy used for the core.

Alternatively, the aluminum alloy used for the first plating layer is preferably at least 10 mV more electron-negative than the alloy used for the core.

The aluminum alloy used for the second plating layer is also preferably at least 10 mV more electron-negative than the alloy used for the core.

This can be obtained with a plating made of an aluminum alloy from the class of alloys EN AW-1000, e.g. EN AW-1050, EN AW-1100, or EN AW-1200, or EN AW-7072, EN AW-7072 mod. +Zn at 0.3-2.5% by weight (EN AW-7072, modified with 0.3-2-5% Zn by weight) or EN AW-303, in which EN AW-3003 is modified with 0.3 to 2.5% Zn by weight (EN AW-3003 modified with 0.3-2.5% Zn by weight).

The electrochemical potential is typically determined by comparison with a reference electrode. By way of example, a standard hydrogen electrode, a normal hydrogen electrode, a saturated calomel electrode, or a silver chloride electrode can be used as the reference electrode.

Depending on the exact composition, a plating made of EN AW-7072 typically has an electrochemical potential of −870 mV (compared to a saturated calomel electrode), and a plating made of an aluminum alloy from the EN AW-1000 class, depending on the exact selection of the materials, has an approx. electrochemical potential of −770 mV (compared to a saturated calomel electrode).

The core, or element that contains aluminum, is preferably formed from a sheet, fin, or tube, which can also exhibit corrugations, grooves, or cuts. This also applies to the plating, because the plating is normally applied prior to the shaping of the component.

The first and second plating are preferably applied with rollers.

Alternatively, the first plating is preferably applied with rollers.

The second plating is also preferably applied with rollers.

The adhesive system for the gluing process preferably contains a polyolefin, epoxy resin, or polyurethane, whereas a polypropylene adhesive is particularly preferred.

The at least one plating layer is preferably applied to the core on the side exposed to air, while the second plating layer is applied to the core on the side exposed to coolant.

Alternatively, the at least one plating layer is applied to the core on the side exposed to air.

The second plating layer is preferably applied to the core on the side exposed to coolant.

It is clear that the air side is the side of the component exposed to air, and the air contains less water or other elements such as soot. The coolant side is the side of the component exposed to coolant. Theoretically, any coolant used for heat management in motor vehicles can be used. By way of example, the coolant can be a polyglycol, typically polyethylene glycol. The type of coolant that is used depends on the temperature range that it is to be used for.

It has proven to be advantageous to glue the at least one element that contains aluminum to at least one second component in the method for producing a heat exchanger for a motor vehicle, and that the adhesive system used for gluing the element that contains aluminum to the second component contains polyolefins, epoxy resin, or polyurethane.

The heat exchanger for a motor vehicle is preferably used in battery cooling plates or radiators.

In one embodiment of a radiator, the element that contains aluminum is advantageously a plate or flat tube, with numerous corrugated fins glued thereto. In the case of a plate, the overall thickness of the element that contains aluminum is preferably 0.15 mm to 6 mm. In the case of a flat tube, it is advantageous to glue numerous adjacent flat tubes to another element, e.g. a base.

To increase corrosion resistance, a plating can be applied to one or both sides of the material. This plating can be applied to either the side exposed to air, or the side exposed to coolant. The plating can also be applied to both the side exposed to air and the side exposed to coolant.

To obtain a sufficient corrosion resistance, it has proven to be advantageous when the thicknesses of the plating layers are 5 to 20% of the overall thickness of the at least one element that contains aluminum. It has proven to be particularly advantageous when the thicknesses of the plating layers are 10 to 15% of the overall thickness of the element that contains aluminum.

Alternatively, it has proven to be advantageous with regard to sufficient corrosion resistance when the thickness of the first plating layer is 5 to 20% of the overall thickness of the at least one element that contains aluminum. It has proven to be particularly advantageous when the thickness of the first plating layer is 10 to 15% of the overall thickness of the element that contains aluminum.

It has also proven to be advantageous with regard to sufficient corrosion resistance when the thickness of the second plating layer is 5 to 20% of the overall thickness of the at least one element that contains aluminum. It has proven to be particularly advantageous when the thickness of the second plating layer is 10 to 15% of the overall thickness of the element that contains aluminum.

Any of the alloys specified in the context of plating layers can be used for the plating layers. If an aluminum alloy that contains Zn is used, e.g. EN AW-7072, the overall zinc content must be limited in order to ensure that it can be completely recycled. The maximum zinc content is dependent on the overall amount of material that is used and to be recycled, and the intended maximum zinc content in the recycling material.

Any of the tempering states known in the prior art can be used for the aluminum alloys used in the tube material or plates that are typical materials in heat exchangers. The tempering states can be, e.g., "O," "H22,", "H24," or various "H1x" states, in which "x" is a natural number between 1 and 9. The state resulting from an annealing process can also be very advantageous. Particularly preferred are "re-annealed" or "partially annealed" states ("H2X") or completely annealed states ("O"). The balance between being able to shape the final product during production and the rigidity of the finished product is decisive.

The material used for the corrugations in a glued radiator can be selected on the basis of its capacity for shaping, rigidity, corrosion resistance, and the recycling portion of the alloy. Fundamentally, any of the tempering states known from the prior art are conceivable that are typical for materials in heat exchangers. The use of "re-annealed" or "partially annealed" states (H2X), fully annealed states ("O"), or heat treated states "H14" or "H16" has proven to be particularly advantageous.

In one embodiment of a glued radiator, the galvanic compatibility, e.g. between the tube material and corrugation material, is of no consequence. This preferred embodiment therefore has the additional advantage that lower aluminum alloys form the EN AW-3000 and EN AW-5000 classes can be used, which have advantages with regard to recycling.

The material used to make the base of a radiator is preferably the same aluminum alloy used to make the tubes, to ensure that additional cleaning is not needed for recycling. It is also advantageous when the base material is fully or partially annealed, e.g. exhibiting the tempering state "O" or "H2X," such that the material can be sufficiently shaped to obtain the base in a stamping process.

In an advantageous embodiment of a battery cooling plate, the overall thickness of the aluminum sheet is 0.2 mm to 3.0 mm.

Plating only needs to be applied to one side, although it can also be applied to both sides. The platings on different sides can be made of different aluminum alloys, to obtain different properties.

The thicknesses of the platings and the core can differ, depending on the requirements for the heat exchanger. Heat exchangers used in fuel cells or for cooling batteries are typically subjected to higher requirements regarding the conductivity of the coolant. With these applications, the conductivity of the coolant must be limited to prevent short circuiting. It should be noted that in some circumstances, parts of the aluminum alloy can be released that can dissolve in coolant.

For this reason, it may be advantageous to passivate the heat exchanger, in which the material used to passivate the inside can be the same or a different material than that used to passivate the outside. This depends on the corrosion resistance requirements.

It has proven to be advantageous to make the plating on the side exposed to air more corrosion resistant. This can be accomplished through the use of EN AW-1050 or an aluminum alloy that contains Zn, e.g. EN AW-7072. If an aluminum alloy that contains Zn is used, the overall thickness of the plating is typically limited to 10% of the overall thickness of the component, to avoid adding too much Zn to the recycling system.

Conceivably, any alloy can be used on the coolant side that is more pure than the alloy used for the core, i.e. any alloy that contributes fewer impurities to the aluminum recycling circuit than the alloy used for the core. This means that the alloy that is used to plate the core should also be such that it does not contribute large amounts of additional impurities to the resulting aluminum alloy. Another advantage therewith is that these alloys result in lower corrosion.

It is also conceivable for there to be no plating on the coolant side.

It is also advantageous to use a typical double layer design, comprising a base plate and a channel plate, which can have different tempering states resulting in the best possible compromise between rigidity and malleability. This design is particularly ideal for battery cooling plates.

It is clear that the features specified above and to be explained below can be used not only in the given combinations, but also in other combinations, or in an of themselves, without abandoning the framework of the invention.

Figure 2:
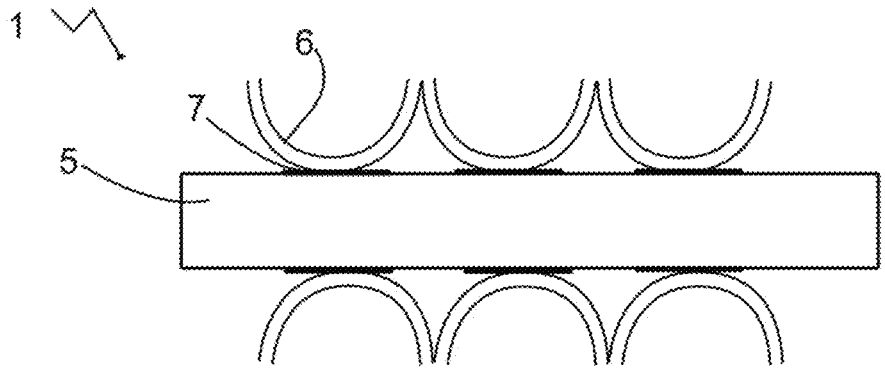
Figure 3:
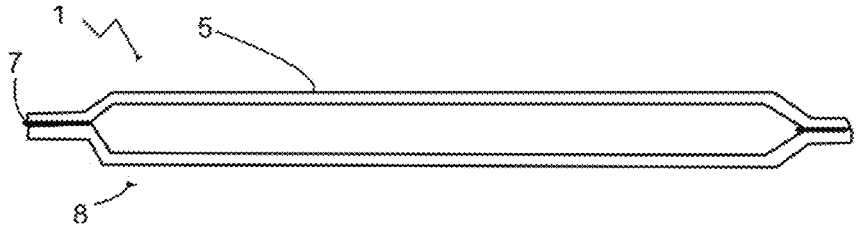
Figure 4:
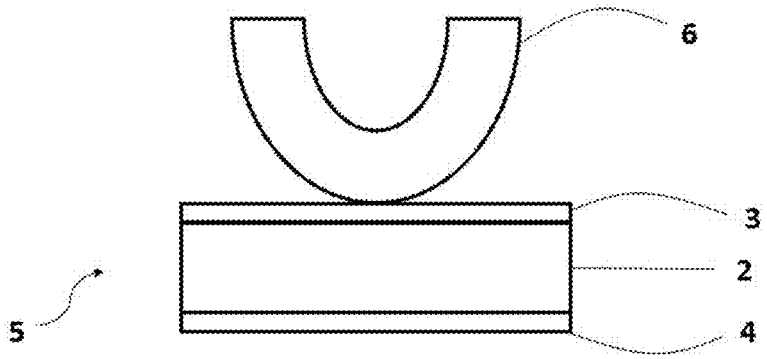
Figure 5:
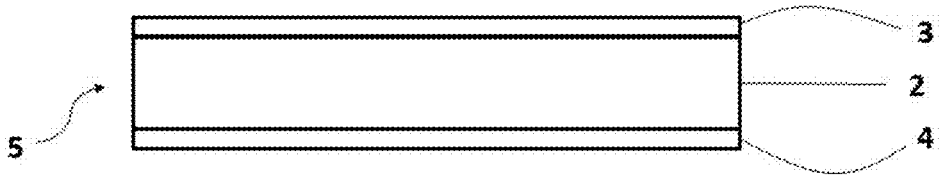
Figure 6:
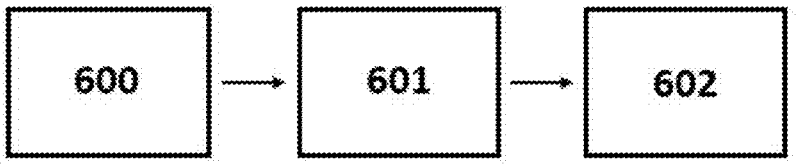

Further advantages of the invention shall be described in the following descriptions of the drawings. Therein, schematically:

FIG. 1: shows a cross section of an example of a preferred element that contains aluminum, with plating on both sides, in the form of a plate;

FIG. 2: shows an exemplary part of a cross section of a preferred radiator that is glued together;

FIG. 3: shows a cross section of a preferred exemplary battery cooling plate that is glued together;

FIG. 4: shows a section of the part of the preferred radiator from FIG. 2, that is glued together;

FIG. 5: shows a rough illustration of the layers of an element that contains aluminum in a preferred battery cooling plate such as that shown in FIG. 3; and FIG. 6: shows a flow chart for an advantageous embodiment of the method according to the invention.

FIG. 1 shows an advantageous embodiment of an element 5 that contains aluminum, the core 2 of which is plated on both sides. This core 2 could also be plated on just one side. FIG. 1 also shows variables d, d2, d3, and d4. In this case, d represents the overall thickness of the element 5 that contains aluminum, d2 indicates the thickness of the core 2, d3 indicates the thickness of the at least one plating layer 3, and d4 indicates the thickness of the at least one second plating layer 4. If there is no second plating layer 4, the thickness d4 is eliminated. FIG. 1 shows the element 5 that contains aluminum in a cross section at a right angle to the length of the component.

FIG. 2 shows a schematic illustration of a cross section of part of a preferred radiator that is glued together. The element 5 that contains aluminum is a flat tube to which numerous corrugated fins have been bonded with an adhesive 7. The overall thickness of the element 5 that contains aluminum is advantageously 0.15 mm to 6 mm.

Possible combinations of substances for preferred corrugated fins can be derived from FIG. 4, which shall be explained in greater detail below.

FIG. 3 shows a schematic illustration of a battery cooling plate that is glued together, which comprises an element 5 that contains aluminum in the form of a bent plate, that is bonded with an adhesive 7 to a second component 8, which is also a bent plate, such that a hollow chamber is formed between the two plates. The second component 8 can also be an element 5 that contains aluminum, resulting in a component with an internal hollow chamber that can contain coolant. The overall thickness of the element 5 that contains aluminum is preferably 0.2 mm to 3.0 mm.

FIG. 4 shows a rough illustration of the layers of an element 5 that contains aluminum, to which a corrugated fin 6 is attached, thus showing a cross section of a preferred radiator that is glued together. The side exposed to air is has a plating 3 composed of EN AW-1050, EN AW-7072, or EN AW-3003 mod. +Zn, the core 2 is an EN AW-3104 aluminum alloy in various tempering states "Hxx," and the side exposed to coolant is a plating 4 composed of EN AW-1050, EN AW-7072, or EN AW-3003 mod. +Zn.

FIG. 5 shows an exemplary structure for a preferred battery cooling plate that is glued together. The plating 3 on the side exposed to air in this case is also composed of EN AW-1050, EN AW-7072, or EN AW-3003 mod. +Zn, the core 2 is an EN AW-3104 aluminum alloy in various tempering states "Hxx," and the side exposed to coolant is a plating 4 composed of EN AW-1050, EN AW-7072, or EN AW-3003 mod. +Zn.

FIG. 6 shows the step 600 in which at least one element that contains aluminum is provided. This at least one element that contains aluminum has a core and at least one plating layer. The core is composed of a first aluminum alloy that contains approx. 0.5% to approx. 4% by weight Mn, and approx. 0.5% to approx. 4% by weight Mg. A second component is provided according to the invention in the subsequent step 601. This second component can also be made of aluminum or an aluminum alloy. Numerous elements that contains aluminum and/or numerous additional components could also be provided. FIG. 6 also shows an optional step 602. It has proven to be particularly advantageous for step 602 to follow step 601. The at least one element that contains aluminum is glued to the at least one second component in step 602. It has proven to be particularly advantageous to glued the components together using an adhesive system containing polyolefins, epoxy resins, or polyurethane. The use of an adhesive system containing polyolefins is particularly preferred.

The specification can be readily understood with reference to the following Numbered Paragraphs:

Numbered Paragraph 1. A heat exchanger (1) for a motor vehicle, containing at least one element (5) that contains aluminum, wherein the at least one element (5) that contains aluminum has a core (2) and at least one plating layer (3), wherein the core (2) is composed of a first aluminum alloy, wherein the first aluminum alloy contains approx. 0.5% to approx. 4% by weight Mn, and approx. 0.5% to approx. 4% by weight Mg, and wherein the at least one plating layer (3) is composed of at least one other aluminum alloy.

Numbered Paragraph 2. The heat exchanger (1) for a motor vehicle according to Numbered Paragraph 1, characterized in that the core (2) is composed of a first aluminum alloy that contains 0 to 1.0% by weight Si, 0 to 1.0% by weight Fe, 0.05 to 0.8% by weight Cu, 0.5 to 2.0% by weight Mn, 0.5 to 2.0% by weight Mg, 0 to 1.0% by weight Zn, and less than 0.05% by weight other components, preferably containing 0 to 0.6% by weight Si, 0 to 0.8% by weight Fe, 0.05 to 0.25% by weight Cu, 0.8 to 1.4% by weight Mn, 0.8 to 1.3% by weight Mg, 0 to 0.25% by weight Zn, and less than 0.05% by weight other components.

Numbered Paragraph 3. The heat exchanger (1) for a motor vehicle according to Numbered Paragraph 1 or 2, characterized in that the core (2) contains at least one second plating layer (4), wherein the at least one second plating layer (4) is on the side of the core (2) opposite the at least one plating layer (3).

Numbered Paragraph 4. The heat exchanger (1) for a motor vehicle according to any of the Numbered Paragraphs 1 to 3, characterized in that the at least one plating layer (3) and/or the at least one second plating layer (4) contain 0.006 to 0.8% by weight Si, 0.006 to 0.8% by weight Fe, 0.003 to 0.20% by weight Cu, 0.002 to 0.30% by weight Mn, 0.006 to 0.30% by weight Mg, 0.006 to 1.5% by weight Zn, and less than 0.05% by weight other components.

Numbered Paragraph 5. The heat exchanger (1) for a motor vehicle according to any of the Numbered Paragraphs 1 to 4, characterized in that the at least one element (5) that contains aluminum is glued to at least one other component.

Numbered Paragraph 6. The heat exchanger (1) for a motor vehicle according to any of the Numbered Paragraphs 1 to 5, characterized in that the thickness (d3) of the at least one plating layer (3) and/or the thickness (d4) of the at least one second plating layer (4) is 5 to 20% of the overall thickness of the at least one element (5) that contains aluminum, and this thickness (d3) of the at least one plating layer (3) and/or the thickness (d4) of the at least one second plating layer (4) is preferably 10 to 15% of the overall thickness of the at least one element (5) that contains aluminum.

Numbered Paragraph 7. The heat exchanger (1) for a motor vehicle according to any of the Numbered Paragraphs 1 to 6, characterized in that the portion of recycled aluminum in the at least one element (5) that contains aluminum is more than 50% in at least the core (2), and preferably the portion of recycled aluminum in the at least one element (5) that contains aluminum is more than 80%, at least in the core (2).

Numbered Paragraph 8. The heat exchanger (1) for a motor vehicle according to any of the Numbered Paragraphs 1 to 7, characterized in that the aluminum alloy used for the at least one plating layer (3) and/or the at least one second plating layer (4) is at least 10 mV more electron-negative than the aluminum alloy used for the core (2).

Numbered Paragraph 9. The heat exchanger (1) for a motor vehicle according to any of the Numbered Paragraphs 1 to 8, characterized in that the element (5) that contains aluminum forms a sheet, fin, or tube, wherein the sheet, fin, or tube can also have corrugations, grooves, or notches.

Numbered Paragraph 10. The heat exchanger (1) for a motor vehicle according to any of the Numbered Paragraphs 1 to 9, characterized in that the at least one plating layer (3) and/or the at least one second plating layer (4) are applied with rollers.

Numbered Paragraph 11. The heat exchanger (1) for a motor vehicle according to any of the Numbered Paragraphs 5 to 10, characterized in that the adhesive system used for gluing contains polyolefins, epoxy resins, or polyurethane, preferably polypropylene.

Numbered Paragraph 12. The heat exchanger (1) for a motor vehicle according to any of the Numbered Paragraphs 1 to 11, characterized in that the at least one plating layer (3) is attached to the side of the core exposed to air, and/or the at least one second plating layer (4) is attached to the core on the side exposed to coolant.

Numbered Paragraph 13. A method for producing a heat exchanger (1) according to any of the Numbered Paragraphs 1 to 11 for a motor vehicle, wherein at least one element (5) that contains aluminum is provided, wherein a second component is provided, wherein the at least one element (5) that contains aluminum has a core (2) and at least one plating layer (3), wherein the core (2) is composed of a first aluminum alloy, wherein the first aluminum alloy contains approx. 0.5% to approx. 4% by weight Mn, and approx. 0.5% to approx. 4% by weight Mg.

Numbered Paragraph 14. The method for producing a heat exchanger (1) for a motor vehicle according to Numbered Paragraph 13, characterized in that the at least one element (5) that contains aluminum is glued to at least one second component, and the at least one element (5) that contains aluminum is preferably glued to the second component using an adhesive system containing polyolefins, epoxy resins, or polyurethane.

Numbered Paragraph 15. Use of the heat exchanger (1) for a motor vehicle according to any of the Numbered Paragraphs 3 to 11 in battery cooling plates or radiators.

LIST OF REFERENCE SYMBOLS

1 heat exchanger
2 core
3 at least one plating layer
4 at least one second plating layer
5 at least one element that contains aluminum
d overall thickness of the at least one element that contains aluminum
d2 thickness of the core
d3 thickness of the at least one plating layer
d4 thickness of the at least one second plating layer
6 corrugation
7 adhesive
8 second plate in a battery cooling plate in a double layered design
600 providing at least one element that contains aluminum
601 providing a second component
602 gluing the at least one element that contains aluminum to the at least one second component

The invention claimed is:

1. A heat exchanger for a motor vehicle, comprising
at least one element that contains aluminum,
wherein the at least one element that comprises aluminum has a core and at least one plating layer,
wherein the core comprises a first aluminum alloy,
wherein the first aluminum alloy comprises recycled aluminum,
wherein the first aluminum alloy comprises Chromium, Nickel, Gallium, Vanadium, and Titanium in an amount less than 0.05%, wherein the first aluminum alloy comprises contains about 0.5% to about 4% by weight Mn, and about 0.5% to about 4% by weight Mg, and wherein the at least one plating layer is composed of a second aluminum alloy that is different from the first.

2. The heat exchanger for a motor vehicle according to claim 1, wherein the core comprises the first aluminum alloy that contains 0 to 1.0% by weight Si, 0 to 1.0% by weight Fe, 0.05 to 0.8% by weight Cu, 0.5 to 2.0% by weight Mn, 0.5 to 2.0% by weight Mg, 0 to 1.0% by weight Zn, and less than 0.05% by weight other components.

3. The heat exchanger for a motor vehicle according to claim 1, wherein the core contains at least one second plating layer, wherein the at least one second plating layer is on a side of the core opposite the at least one plating layer.

4. The heat exchanger for a motor vehicle according to claim 3, wherein the at least one plating layer and/or the at least one second plating layer contain 0.006 to 0.8% by weight Si, 0.006 to 0.8% by weight Fe, 0.003 to 0.20% by weight Cu, 0.002 to 0.30% by weight Mn, 0.006 to 0.30% by weight Mg, 0.006 to 1.5% by weight Zn, and less than 0.05% by weight other components.

5. The heat exchanger for a motor vehicle according to claim 1, wherein the at least one element that contains aluminum is glued with an adhesive to at least one other component.

6. The heat exchanger for a motor vehicle according to claim 3, wherein the thickness (d3) of the at least one plating layer and/or the thickness (d4) of the at least one second plating layer is 5 to 20% of the overall thickness of the at least one element that contains aluminum.

7. The heat exchanger for a motor vehicle according to claim 1, wherein the recycled aluminum is present in a quantity greater than 50% in at least the core.

8. The heat exchanger for a motor vehicle according to claim 3, wherein the aluminum alloy used for the at least one plating layer and/or the at least one second plating layer is at least 10 mV more electron-negative than the aluminum alloy used for the core.

9. The heat exchanger for a motor vehicle according to claim 1, wherein the element that contains aluminum forms a sheet, fin, or tube, and wherein the sheet, fin, or tube further comprises corrugations, grooves, or notches.

10. The heat exchanger for a motor vehicle according to claim 3, wherein the at least one plating layer and/or the at least one second plating layer are applied with rollers.

11. The heat exchanger for a motor vehicle according to claim 5, wherein the adhesive contains polyolefins, epoxy resins, or polyurethane, preferably polypropylene.

12. The heat exchanger for a motor vehicle according to claim 3, wherein the at least one plating layer is attached to the side of the core exposed to air, and/or the at least one second plating layer is attached to the core on the side exposed to coolant.

13. The heat exchanger for a motor vehicle of claim 2, wherein the first aluminum allow comprises 0 to 0.6% by weight Si, 0 to 0.8% by weight Fe, 0.05 to 0.25% by weight Cu, 0.8 to 1.4% by weight Mn, 0.8 to 1.3% by weight Mg, 0 to 0.25% by weight Zn, and less than 0.05% by weight other components.

14. The heat exchanger of claim 6, wherein the thickness (d3) of the at least one plating layer and/or the thickness (d4) of the at least one second plating layer is preferably 10 to 15% of the overall thickness of the at least one element that contains aluminum.

15. The heat exchanger of claim 7, wherein the portion of recycled aluminum in the at least one element that contains aluminum is more than 80%, at least in the core.

* * * * *